US005640731A

United States Patent [19]

Toedter

[11] Patent Number: 5,640,731

[45] Date of Patent: Jun. 24, 1997

[54] AIR MATTRESS

[76] Inventor: Manfred Toedter, Im Gehecht 26, 29643 Neuenkirchen, Germany

[21] Appl. No.: 334,602

[22] Filed: Nov. 4, 1994

[30] Foreign Application Priority Data

Nov. 8, 1993 [DE] Germany ..... 43 38 008.5

[51] Int. Cl.[6] ..... A47C 27/08; A47C 27/10

[52] U.S. Cl. ..... 5/713; 5/710

[58] Field of Search ..... 5/453, 455, 456

[56] References Cited

U.S. PATENT DOCUMENTS

| | | | |
|---|---|---|---|
| 2,434,641 | 1/1948 | Burns | 5/455 |
| 4,422,194 | 12/1983 | Viesturs et al. | 5/455 |
| 4,852,195 | 8/1989 | Schulman | 5/453 |
| 4,864,671 | 9/1989 | Evans | 5/453 |
| 4,982,466 | 1/1991 | Higgins et al. | 5/453 |
| 5,030,501 | 7/1991 | Colvin et al. | 5/453 |
| 5,052,068 | 10/1991 | Graebe | 5/455 |
| 5,249,318 | 10/1993 | Loadsman | 5/453 |

FOREIGN PATENT DOCUMENTS

| | | | |
|---|---|---|---|
| 76326 | 8/1972 | German Dem. Rep. . | |
| 1873725 | 4/1963 | Germany . | |
| 2516539 | 10/1976 | Germany . | |
| 3303615 | 8/1984 | Germany . | |
| 4101781 | 7/1992 | Germany . | |
| 626272 | 10/1961 | Italy | 5/455 |
| 0626272 | 10/1961 | Italy | 5/455 |

*Primary Examiner*—Steven N. Meyers
*Assistant Examiner*—Robert G. Santos
*Attorney, Agent, or Firm*—W. G. Fasse; W. F. Fasse

[57] ABSTRACT

An air mattress has a plurality of air cells formed in or by an elastic casing. The air cells are connected in series and in parallel with each other by a plurality of air channels. Mattress sections and subsections are formed by combining the channels into groups providing at least one channel group for each section or subsection. Perforations pass through the casing outside the air cells and outside the air channels for ventilating. Air ducts interconnect neighboring mattress sections.

17 Claims, 2 Drawing Sheets

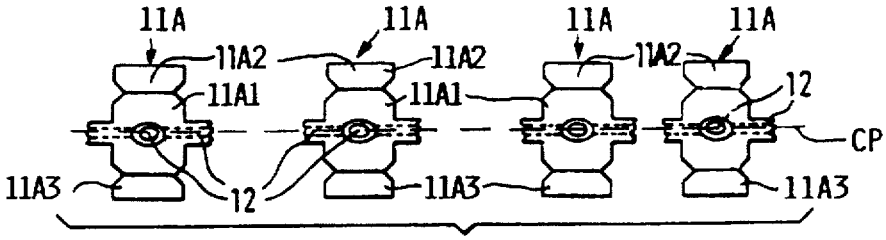
Fig. 3A
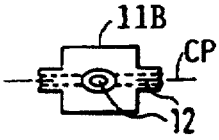
Fig. 3B
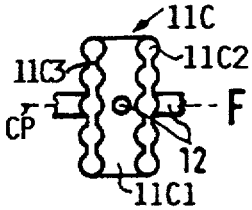
Fig. 3C
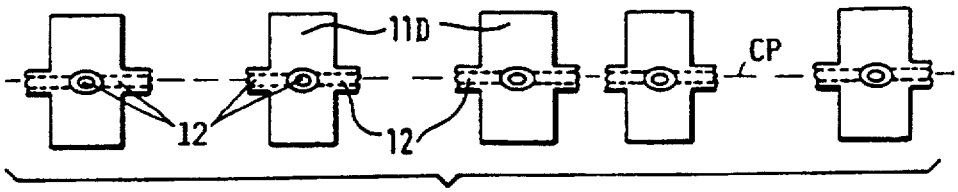
Fig. 4
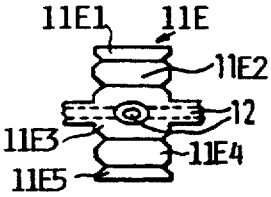
Fig. 5A
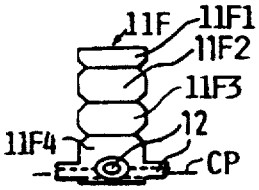
Fig. 5B
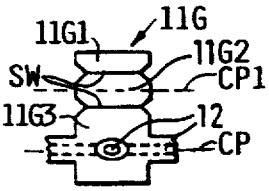
Fig. 5C
FIG. 6A
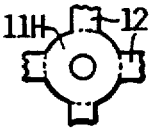
FIG. 6B
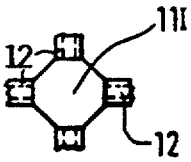
FIG. 6C
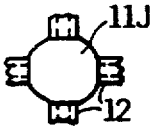
FIG. 6D
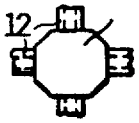
FIG. 6E
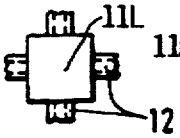
FIG. 6F
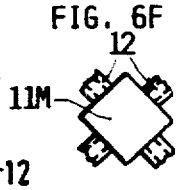

AIR MATTRESS

FIELD OF THE INVENTION

The invention relates to an air mattress that may be used for camping purposes, on cots, and any other situation where an air mattress or an air core is used conventionally. Such air mattresses are made of an elastic casing that may be subdivided into a multitude of air cells that can be pressurized.

BACKGROUND INFORMATION

Air mattresses of the type described above are well known. German Patent Publication 3,303,615 (Hobbensiefken) published on Aug. 9, 1984 discloses an air mattress which has about 200 cells of standardized size. For this purpose a casing of synthetic material is provided with a correspondingly large number of pockets into which individual inflatable air cells are inserted. The casing has the insertion openings for the individual air cells and additional openings to save material. The individual cells may have various shapes including bellows shapes. By individually inflating each of these cells that can be taken out of the casing it is possible to enable the mattress to adapt its surface configuration easily to different body shapes of different users.

German Patent Publication DE 4,101,781 A1 (Kolb) published on Jul. 23, 1992 discloses an air mattress in which a casing itself is divided into a plurality of chambers. These chambers are also individually inflatable and thus are adaptable to the user's body configuration.

The above described air mattresses do not permit an air exchange between neighboring air cells or chambers, whereby the adaptation of the air cells or chambers to the body shape of the user depends solely on the different degrees of inflating the cells and chambers. Thus, such structures leave room for improvement especially with regard to making an air mattress more comfortable than was possible heretofore. The just described air mattresses also do not provide any venting, for example in order to let moisture escape when the user is perspiring.

German Patent Publication DE 2,516,539 (Herbst) published on Oct. 28, 1976 discloses air pressurized upholstery cores, for example, for bed mattresses. A casing formed of a foam material has individual inflatable rubber cells embedded in the foam material. The rubber cells are interconnected by an air channel that connects the air cells in series. The size of the air cells shall vary throughout the foam rubber core in order to provide again an adaptation to the various body shapes of a user. The individual cells may also have different configurations, for example, a cubic shape or a star shape, whereby these shapes are to be interconnected at their corners or tips in such a way that the air can travel from one cube to the other or from one star-shaped configuration to the other.

East German Patent Publication 76,326 (Meyer), published on Aug. 5, 1972 discloses an inflatable air mattress divided into a plurality of sections each of which is further divided into a multitude of air cells that are separated from each other by welding seams (18), but interconnected by channels not shown. Each field is individually inflatable through nipples (15, 16). The fields are separated by strips that are not inflatable so that the air mattress can be folded. Inflatable air cells (19) are positioned at the corners of the larger square air cells (1).

German Utility Model DE-U-1,873,725 (Cecioni), published on Apr. 17, 1963 disloses an inflatable air mattress wherein a multitude of cells is connected in series and individual mattress sections are insertable into a foam rubber casing in which the air mattress sections form a core. Venting holes are provided between neighboring air cells without communicating with these air cells.

The above discussed publications leave room for improvement especially with regard to a rapid inflation and deflation as well as with an adaptation of individual mattress areas to desired degrees of hardness.

OBJECTS OF THE INVENTION

In view of the above it is the aim of the invention to achieve the following objects singly or in combination:

- to construct an inflatable air mattress with an elastic casing in such a way that a pressure equalization between neighboring cells of the air mattress depends on the pressure exerted on the particular cell by a person using the mattress;
- to provide the mattress with venting holes for permitting moisture to readily escape;
- to permit a rapid inflation and deflation of the air mattress; and
- to interconnect individual mattress sections or subsections with other sections or subsections of the mattress through external air ducts.

SUMMARY OF THE INVENTION

The above objects have been achieved according to the invention by incorporating into an elastic casing a plurality of pressurized air cells that are interconnected by a channel system, preferably so that most cells of a mattress section are connected in series and in parallel with one another. The channel system or several channel systems formed by groups of channels are arranged in at least one common plane or in several common planes. A plurality of perforations pass through the casing without influencing the air cells and without influencing the interconnecting channel system. These perforations extend substantially perpendicularly to the mentioned common plane and permit the escape or venting of moisture.

According to the invention the air mattress, or rather all cells of the air mattress are initially inflated to the same pressure, but when a person rests on the present mattress a pressure distribution will take place from cell to cell in such a way that the cell pressure will depend on the pressure exerted by the particular body portion of the user of the mattress. This feature permits an optimal comfort for the user. Further, the venting perforations assure an adequate venting for the removal of moisture, for example if the user should be perspiring.

BRIEF DESCRIPTION OF THE DRAWINGS

In order that the invention may be clearly understood, it will now be described, by way of example, with reference to the accompanying drawings, wherein:

FIG. 3A shows one possible configuration for the air cells in a mattress according to the invention;

FIG. 3B shows a relatively flat cell configuration suitable for a compact air mattress;

FIG. 3C shows a longitudinal-section through a modified air cell configuration having a central longitudinal hole and a plurality of ring-shaped cell sections surrounding the central hole;

FIG. 4 shows an air cell configuration with a rectangular vertical section;

FIG. 5A shows a bellows type air cell configuration with air channels passing centrally through the largest bellows chamber;

FIG. 5B shows another bellows type air cell configuration with the air channels passing through in a common bottom plane;

FIG. 5C shows still another bellows type air cell configuration with a common channel plane positioned somewhat above the bottom plane of the mattress casing; and FIGS. 6A–6F show various sectional configurations for the present air cells including several possibilities of connecting the air channels to the air cells.

DETAILED DESCRIPTION OF PREFERRED EXAMPLE EMBODIMENTS AND OF THE BEST MODE OF THE INVENTION

Figure 1:
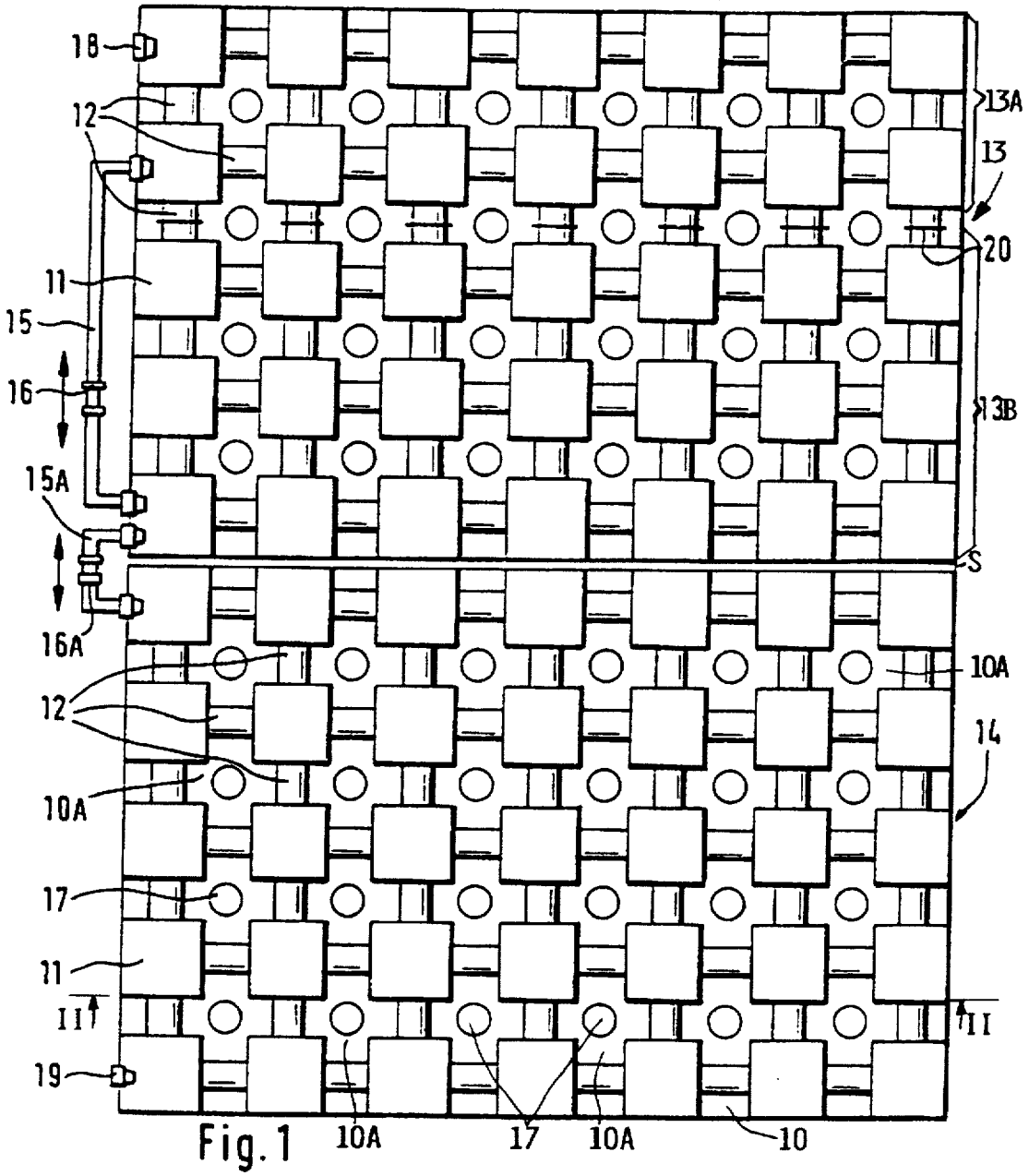
FIG. 1 is a plan view of an air mattress according to the invention showing air cells in a mattress casing.

FIG. 1 shows a mattress core or casing 10 forming two mattress sections 13 and 14. The core 10 includes a plurality of casing sections 10A. Each mattress section 13, 14 comprises a plurality of pressurizable air cells 11 interconnected by horizontally and vertically extending air channels 12 forming a separate channel system for each mattress section 13, 14. In mattress section 13 the channel system is subdivided by partition walls 20 to form a channel subsystem 13A and a channel subsystem 13B. These channel subsystems cannot directly communicate air from one subsystem to the other due to the partition walls 20. However, the subsystem 13A can pass air into the subsystem 13B through an external air duct 15 and a valve 16. Similarly, the channel subsystem 13B can communicate air through an external air duct 15A and a valve 16A in the external air duct 15A. Additionally, the mattress section 13 is equipped with an air nipple 18 and the section 14 is equipped with an air nipple 19 for inflating and deflating. As shown in FIG. 1, vertical sections of the air channels 12 connect air cells 11 of a vertical air cell column in series with each other. Horizontal sections of the air channels 12 connect neighboring columns of series connected air cells 11 in parallel with each other.

The air nipples or valves 18 and 19 and the valves 16 and 16A permit filling the various sections to different pressure levels. Additionally, the partition walls 20 may be placed anywhere within the air channels of the air channel system or subsystems, including the horizontally extending air channels. The subsystem 13A may, for example, form a head section of the mattress while the subsection 13B forms an upper body support. Subsection 14 then forms a support for the lower body.

When the air mattress is initially filled, either to a uniform pressure level in all sections, or to different pressure levels in different sections or subsections, a pressure distribution or equalization will take place among the individual air cells 11 when a person is resting on the mattress. The pressure equalization or distribution can be controlled by the user by operating the valves 16 and 16A.

Figure 2:
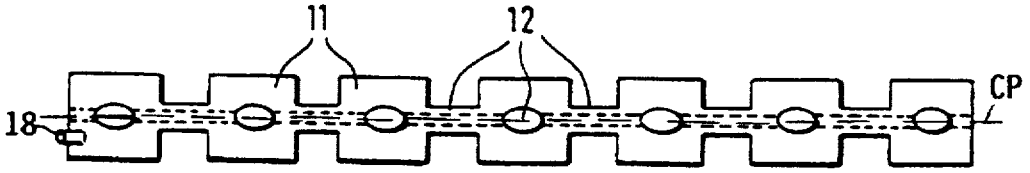
FIG. 2 is a view along section plane II—II in FIG. 1.

Viewing FIGS. 1 and 2 together, all air cells 11 have a square cross-section and a cubic configuration in this embodiment. All air channels 12 are positioned in a common plane CP as shown in FIG. 2. This common plane CP is preferably located centrally in the embodiment of FIGS. 1 and 2, however, it does not need to be positioned in such a central level.

According to the invention each of the casing sections 10A of the casing 10 is provided with at least one perforation 17 so that a multitude of perforations 17 permits ventilation for the removal of moisture. These perforations 17 extend with their central axis perpendicularly to the central plane CP. The perforations 17 do not adversely influence the airtightness of the air cells 11 nor of the air channels 12 because the casing sections 10A space the air cells 11. Although round perforations 17 are shown, perforations having any suitable cross-sectional configuration may be used. Each of the perforations 17 is surrounded by a plurality of the air cells 11 without reducing any cross-sectional flow area of the air channels 12 as best seen in FIG. 1.

FIG. 3A shows a vertical elevation of one type of air cells 11A having a largest cell chamber or hollow body 11A1 centrally positioned between two smaller cell chambers 11A2 and 11A3. All air cells 11A in this embodiment of the present mattress have the same configuration. The air channels 12 pass centrally into and out of the central cell chamber 11A1 and are so positioned that all channels 12 are located substantially in a common plane CP. The term "common" here means that the plane is common to all channels 12 so that all channels 12 are positioned substantially in the same plane. Each largest cell chamber 11A1 forms with two smaller cell chambers 11A2 and 11A3 a bellows air cell.

FIG. 3B shows a relatively flat air cell lib having a substantially square cross-sectional configuration, whereby again the air channels 12 are located in the common central plane CP.

FIG. 3C shows a vertical section through yet another bellows air cell 11C having a configuration with a central through hole or opening 11C1 surrounded by interconnected ring chambers 11C2. All ring chambers communicate with each other through neck portions 11C3. The air channels 12 preferably pass through the central ring chamber. Two of such chambers extend above the central common plane defined by the air channels 12 and two of such ring chambers extend below the common plane CP. In FIG. 3C the central opening 11C1 assumes the a venting function similar of that of the perforations 17 shown in FIG. 1. The ring chambers 11C2 with their interconnecting neck portions 11C3 form bellows air cells.

FIG. 4 illustrates air cells lid having a substantially rectangular vertical longitudinal section except where the air channels 12 enter and exit the air cells 11D in the common plane CP. The rectangular vertical section of the cells 11D may have any of the horizontal cross-sections shown in FIGS. 6A to 6F.

FIG. 5A shows an air cell lie having several bellows-type chambers 11E1 to 11E5 with the largest chamber 11E3 positioned centrally between the smaller chambers which become progressively smaller the farther these chambers are positioned away from the central largest chamber 11E3 which is connected to the air channels 12 as shown in FIG. 5A.

FIG. 5B shows an air cell 11F with four bellows chambers 11F1 to 11F4, wherein the lowest chamber 11F4 is the largest chamber and forms the bottom chamber through which the air channels 12 enter and exit so that the common plane CP is located near the bottom of the mattress rather than in the center. The intermediate chambers 11F2 and 11F3 are of identical vertical section while the uppermost chamber 11F1 has a smaller cross-section.

FIG. 5C illustrates an air cell 11G having three bellows chambers 11G1, 11G2, and 11G3. The chamber 11G3 is the largest chamber and forms a bottom chamber, however, having such a configuration that the central or common plane CP in which the air channels 12 extend is positioned somewhat above the bottom of the air mattress.

FIG. 6A shows an air cell 11H having a circular cross-section. The air channels 12 are spaced from each other circumferentially around the circular cross-section at 90° spacings, for example.

FIG. 6B shows an air cell 11I with an octagonal cross-section, whereby the air channels 12 are spaced by 90° on sides of the octagonal cross-section. Additionally, the channels 12 have an outer diameter corresponding to the length of an octagonal side.

FIG. 6C shows an air cell 11J having an almost circular horizontal cross-section with flattened sides for the connection of the air channels 12.

FIG. 6D shows an air cell 11K with an octagonal horizontal cross-section, however, having unequal octagonal sides, whereby the air channels 12 are connected to the longer octagonal sides having a length somewhat larger than the outer diameter of the channels 12.

FIG. 6E shows an air cell 11L with a square horizontal cross-section, whereby the air channels 12 are connected to the sides of the square configuration.

FIG. 6F shows an air cell 11M also having a square configuration, however, the air channels 12 are connected to corners of the square configuration.

In air mattresses of the invention having air cells of the type shown, for example, in FIGS. 5A, 5B or 5C, the individual chambers may be closed relative to each other by horizontal separation walls SW for example shown in FIG. 5C. In that case, further air channel systems will interconnect all chambers 11G2 in the same mattress section. The air channels 12 in the plane CP would then extend substantially in parallel to another group or set of air channels interconnecting all chambers 11G2. These air channels are shown by a dashed line and extend in a plane CP1. The same applies to the air cells 11G1.

All air cells are made of elastomeric material, for example, rubber or elastic synthetic material, whereby the material may first be shaped to the desired configurations and then adhesively bonded or welded to form the casing and simultaneously the air cells as described.

While air will be the preferred gas for filling the air mattress, other gases may be suitable for the present purpose, whereby the nipples 18 and 19 will have conventional closure members so as to maintain the pressure once the filling is completed. Since the filling pressure can be adjusted in different sections of the air mattress by the user's operation of the valves 16, 16A during the filling operation, different pressures may be established in different sections 13, 14, 13A, 13B of the present air mattress. The sections 13 and 14 of the mattress shown in FIG. 1 are preferably interconnected by a seam S such as an adhesively bonded seam, a welded seam or the like that does not have any air channels. The seam S is bridged by the air duct 15A for pressure equalization.

Although the invention has been described with reference to specific example embodiments, it will be appreciated that it is intended to cover all modifications and equivalents within the scope of the appended claims.

What is claimed is:

1. An air mattress comprising an elastical casing, a plurality of bellows air cells (11) formed in said elastic casing, central casing sections (10A) surrounding said bellows air cells so that said bellows air cells are spaced from each other by said central casing sections (10A), a plurality of air channels forming a central channel system (12) interconnecting said bellows air cells (11) in said casing midway between ends of said bellows air cells, said central casing sections (10A) between neighboring bellows air cells being free of said central channel system, and at least one perforation (17) in each of said central casing sections (10A), whereby said elastic casing comprises a plurality of perforations (17) positioned outside said air channels, said central casing sections (10A) spacing said perforations from said central channel system (12) and from said bellows air cells (11), wherein said perforations (17) are surrounded by a plurality of said bellows air cells without reducing any cross-sectional flow area of said air channels (12), and wherein said plurality of bellows air cells comprises several bellows chambers including a largest bellows chamber and smaller bellows chambers arranged in a column, and wherein said largest bellows chamber (11E3) is positioned centrally between said smaller bellows chambers, said smaller bellows chambers becoming progressively smaller the farther the smaller bellows chambers are positioned away from said largest bellows chamber which is connected to said air channels.

2. The air mattress of claim 1, further comprising partition walls (20) in said central channel system so that said elastic casing is divided into channel sub-systems (13A, 13B) to form a plurality of mattress sections, each mattress section comprising a number of bellows air cells that are interconnected with each other midway between ends of said bellows air cells, whereby each mattress section is selectively inflatable.

3. The air mattress of claim 2, further comprising at least one by-pass air duct (15), an air flow control valve in said by-pass air duct, said by-pass air duct (15) interconnecting at least two mattress sections with each other, whereby each mattress section is selectively inflatable.

4. The air mattress of claim 1, wherein said bellows air cells have a cell height orthogonally to a central common mattress plane and a varying cross-section along said cell height perpendicularly to said cell height.

5. The air mattress of claim 1, wherein said bellows air cells have a square or octagonal cross-section, and wherein said air channels of said central channel system communicate with said bellows air cells through cell side walls.

6. The air mattress of claim 1, wherein said bellows air cells have a circular cross-section.

7. The air mattress of claim 1, wherein said bellows air cells have a square or octagonal cross-section and wherein said air channels communicate with said bellows air cells through corners of said square or octagonal cross-section.

8. The air mattress of claim 1, wherein said elastic casing is made of an elastomeric rubber material.

9. The air mattress of claim 1, wherein said elastic casing is made of an elastic synthetic material.

10. The air mattress of claim 1, wherein each bellows air cell is directly connected to at least two directly neighboring bellows air cells without any intervening air cell.

11. The air mattress of claim 1, comprising thirty five bellows air cells in a mattress section interconnected by one channel group, each of four of said thirty-five bellows air cells being directly connected by said air channels to two neighboring bellows air cells, each of sixteen of said bellows air cells being directly connected by said air channels to three neighboring bellows air cells, and each of fifteen bellows air cells being directly connected by said air channels to four neighboring bellows air cells.

12. The air mattress of claim 1, wherein said air channels (12) connect said bellows air cells (11) forming a column in series with each other and neighboring columns of bellows air cells (11) are connected in parallel with each other.

13. The air mattress of claim 1, wherein said bellows air cells comprise bellows chambers and at least one separation wall (SW) between two neighboring bellows chambers, said air channels (12) being connected to said bellows chambers.

14. An air mattress comprising an elastical casing, a plurality of bellows air cells (11) formed in said elastic casing, central casing sections (10A) surrounding said bellows air cells so that said bellows air cells are spaced from each other by said central casing sections (10A), a plurality of air channels forming an air channel system (12) interconnecting said bellows air cells (11) in said casing, said central casing sections (10A) between neighboring bellows air cells being free of said air channel system, and at least one perforation (17) in each of said central casing sections (10A), whereby said elastic casing comprises a plurality of perforations (17) positioned outside said air channels, said central casing sections (10A) spacing said perforations (17) from said channel system (12) and from said bellows air cells (11), wherein each of said bellows air cells comprises a plurality of bellows chambers (11E1 to 11E5) including a largest bellows chamber and smaller bellows chambers arranged in a column in which said largest bellows chamber is positioned between said smaller bellows chambers, said largest and smaller bellows chambers communicating with each other, wherein said largest bellows chamber is connected to said air channel system (12) forming a common air channel system, and wherein said perforations (17) are surrounded by said central casing sections (10A) which are in turn surrounded by a plurality of said bellows air cells without reducing any cross-sectional flow area of said air channels.

15. The air mattress of claim 14, wherein said largest bellows chamber (11E3) is positioned centrally between said smaller bellows chambers in said column, said smaller bellows chambers becoming progressively smaller the farther the smaller bellows chambers are positioned away from said largest bellows chamber, whereby said air channel system connected to said largest bellows chamber forms a central air channel system.

16. An air mattress comprising an elastical casing, a plurality of bellows air cells (11) formed in said elastic casing, central casing sections (10A) surrounding said bellows air cells so that said bellows air cells are spaced from each other by said central casing sections (10A), a plurality of air channels (12) forming a central channel system interconnecting said bellows air cells (11) in said casing midway between ends of said bellows air cells, said central casing sections (10A) between neighboring bellows air cells being free of said central channel system, and at least one perforation (17) in each of said central casing sections (10A), whereby said elastic casing comprises a plurality of perforations (17) positioned outside said air channels, said central casing sections (10A) spacing said perforations (17) from said central channel system (12) and from said bellows air cells (11), wherein each perforation (17) is surrounded by a plurality of said bellows air cells without reducing any cross-sectional flow area of said air channels (12), and wherein each bellows air cell (11C) comprises a plurality of ring chambers (11C2) surrounding a central through-hole (11C1) and neck portions (11C3) interconnecting neighboring ring chambers (11C2).

17. An air mattress comprising an elastical casing, a plurality of bellows air cells (11) formed in said elastic casing, central casing sections (10A) surrounding said bellows air cells so that said bellows air cells are spaced from each other by said central casing sections (10A), a plurality of air channels (12) forming a central channel system interconnecting said bellows air cells (11) in said casing, said central casing sections (10A) between neighboring bellows air cells being free of said central channel system, and at least one perforation (17) in each of said central casing sections (10A), whereby said elastic casing comprises a plurality of perforations (17) positioned outside said air channels, said central casing sections (10A) spacing said perforations (17) from said central channel system (12) and from said bellows air cells (11), and wherein said bellows air cells (11) comprise bellows chambers and at least one separation wall (SW) between two neighboring bellows chambers, said air channels (12) being connected to said bellows chambers.

* * * * *

UNITED STATES PATENT AND TRADEMARK OFFICE

CERTIFICATE OF CORRECTION

PATENT NO. : 5,640,731

DATED : June 24, 1997

INVENTOR(S) : Toedter

It is certified that error appears in the above-identified patent and that said Letters Patent is hereby corrected as shown below:

Column 4, line 5, after "cells 11" insert --and the air channels 12 from the perforations 17--;

line 23, replace "cell lib" by --cell 11B--;

line 37, replace "assumes the" by --assumes--;

line 41, replace "cells lid" by --cells 11D--;

line 47, replace "cells lie" by --cells 11E--.

Signed and Sealed this

Twenty-third Day of September, 1997

*Attest:*

Bruce Lehman

BRUCE LEHMAN

*Attesting Officer*

*Commissioner of Patents and Trademarks*